United States Patent [19]

Tamplen

[11] Patent Number: 4,558,895

[45] Date of Patent: Dec. 17, 1985

[54] PULLING TOOL

[75] Inventor: Jack W. Tamplen, Celina, Tex.

[73] Assignee: Otis Engineering Corporation, Dallas, Tex.

[21] Appl. No.: 233,473

[22] Filed: Feb. 11, 1981

[51] Int. Cl.[4] ..... E21B 31/00; E21B 31/02

[52] U.S. Cl. ..... 294/86.18; 294/86.2; 294/86.3

[58] Field of Search ..... 294/86.18, 86.12, 86.14, 294/86.17, 86.23, 86.3, 86.25, 86.19, 86.26, 86.29, 86.2, 86.31, 86.33; 166/88, 89, 99; 175/315

[56] References Cited

U.S. PATENT DOCUMENTS

| | | | |
|---|---|---|---|
| 2,508,285 | 5/1950 | Otis et al. | 294/86 |
| 2,605,131 | 7/1952 | Marshall et al. | 294/86 |
| 3,207,222 | 9/1965 | Tamplen | 166/136 |
| 3,208,531 | 9/1965 | Tamplen | 166/125 |
| 3,628,822 | 12/1971 | Bostock | 294/86.18 |
| 4,127,297 | 11/1978 | Dufrene | 294/86.18 |
| 4,185,865 | 1/1980 | Taylor | 294/86.18 |

OTHER PUBLICATIONS

Booklet—Wireline Production Equipment OEC 5119.

*Primary Examiner*—James B. Marbert
*Attorney, Agent, or Firm*—Thomas R. Felger

[57] ABSTRACT

A pulling tool for retrieving well tools from a well bore. The present invention allows the reach of the pulling tool to be easily varied. The pulling tool can also be assembled for emergency release by either upward or downward shearing forces. The weight of a well tool engaged by the pulling tool is fully supported by the housing of the pulling tool. A manual release feature is provided to release well tools from the pulling tool at the well surface without having to disassemble the pulling tool or shear any pins.

15 Claims, 23 Drawing Figures

PULLING TOOL

BACKGROUND OF THE INVENTION

1. Field of the Invention

The present invention relates to a pulling tool for retrieving well tools from a well bore.

2. Description of the Prior Art

Wireline equipment is frequently used to install and retrieve well tools within the bore of a well flow conductor. Equipment used to install well tools within a well flow conductor is generally referred to as a running tool. Examples of running tools are shown in U.S. Pat. Nos. 3,207,222 and 3,208,531, both to Jack W. Tamplen.

Equipment used to retrieve a well tool from a well flow conductor is generally referred to as a pulling tool. Examples of pulling tools are shown in U.S. Pat. No. 2,508,285 to H. C. Otis et al, U.S. Pat. No. 2,605,131 to S. J. E. Marshall et al, and U.S. Pat. No. 3,628,822 to James H. Bostock. U.S. Pat. No. 3,051,239 to W. W. Dollison shows a pulling tool which can be used for both installing and retrieving well tools.

The above listed U.S. Patents are incorporated by reference for all purposes within this application.

SUMMARY OF THE INVENTION

This invention discloses a pulling tool comprising an elongate core means having a first, second, and third section, a housing means releasably secured to the first section and surrounding the exterior of the second and third sections of the core means, one end of the first section projecting longitudinally from the housing means for engagement with a wireline tool string, the second section having a longitudinal bore partially through one end and threads on the other end, the other end of the first section slidably disposed within the bore of the second section, one end of the third section having threads thereon and engageable with the threads on the other end of the second section, the housing means extending longitudinally from the other end of the third section and having an opening therein to receive a well tool, flexible latching fingers carried by the third section and the housing means projecting longitudinally from the other end of the third section, a shoulder on each finger spaced longitudinally from the other end of the third section projecting radially inward with respect to the opening, the fingers having a first position in which the fingers are flexed inward allowing the shoulders to secure a well tool within the opening and a second position in which the fingers are flexed outward releasing the shoulders from the well tool, and means for varying the longitudinal spacing between the other end of the third section and the shoulders by adjusting the threaded engagement between the second and third sections of the core means.

One object of the present invention is to provide a pulling tool which may be run into a well flow conductor on a flexible or wire line and to releasably engage a well tool disposed within the flow conductor.

Another object of the present invention is to provide a pulling tool having a housing means which carries the full weight of a well tool releasably engaged with the pulling tool.

A further object of the present invention is to provide a pulling tool with an elongate core means which can be easily adjusted to engage fishing necks of various lengths.

An additional object of the present invention is to provide a pulling tool which can be easily disengaged from a well tool at the well surface without having to shear any pins or to disassemble the pulling tool.

A still further object of the present invention is to provide a pulling tool which can be preselected to disengage from a well tool by application of either upward or downward shearing forces.

Additional objects and advantages of the present invention will be apparent from reading the following description in conjunction with the drawings and claims.

DESCRIPTION OF THE PREFERRED EMBODIMENT

Figure 1A:
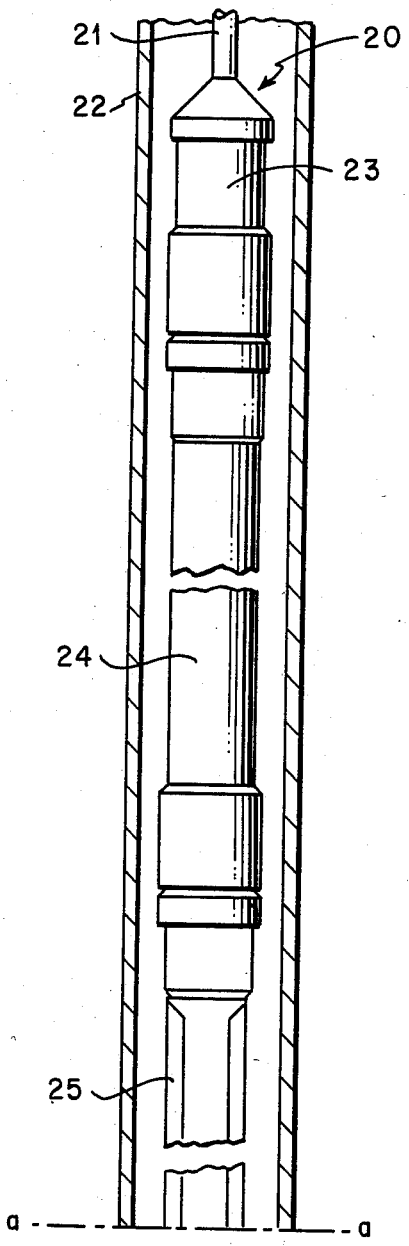
FIGS. 1A, 1B, and 1C are schematic drawings in elevation and section showing a wireline tool string including a pulling tool, incorporating the present invention. The tool string is disposed within a well flow conductor.
Figure 1B:
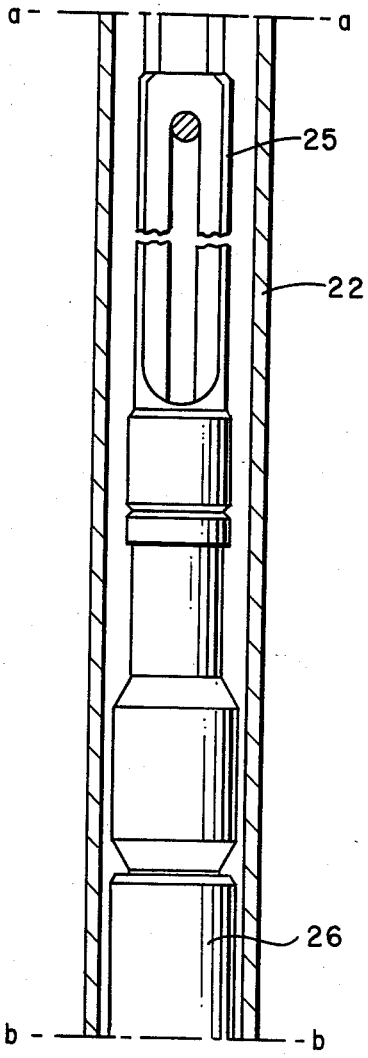
Figure 1C:
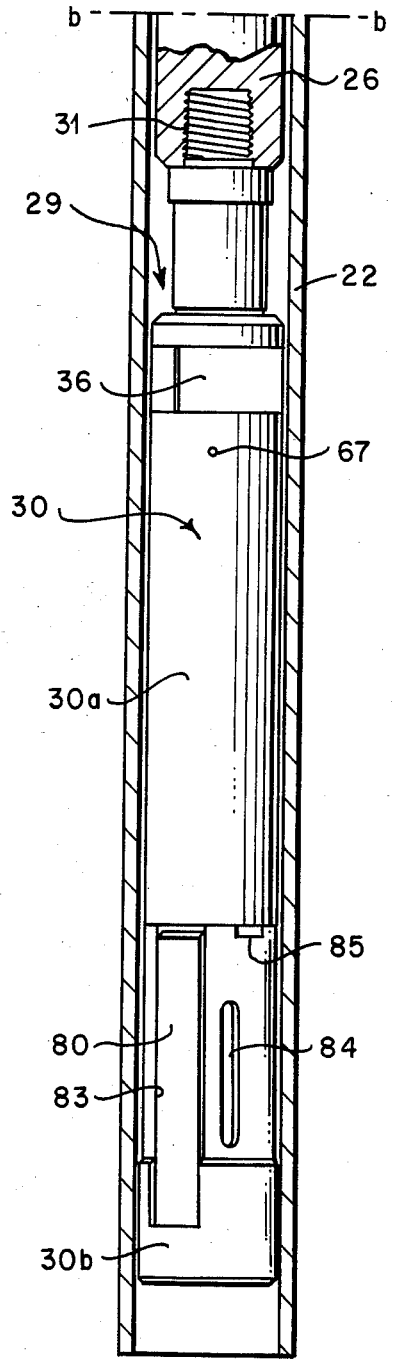

In FIGS. 1A, 1B, and 1C, pulling tool 29 is shown as part of wireline tool string 20 suspended from flexible wireline 21 within well flow conductor or tubing string 22. Tubing string 22 may be part of a standard well completion (not shown). Wireline tool string 20 can be raised and lowered through tubing string 22 by conventional wireline techniques to install and/or retrieve a well tool within tubing string 22 at a selected downhole location. Pulling tool 29 is preferably used for retrieving well tools.

Figure 18:
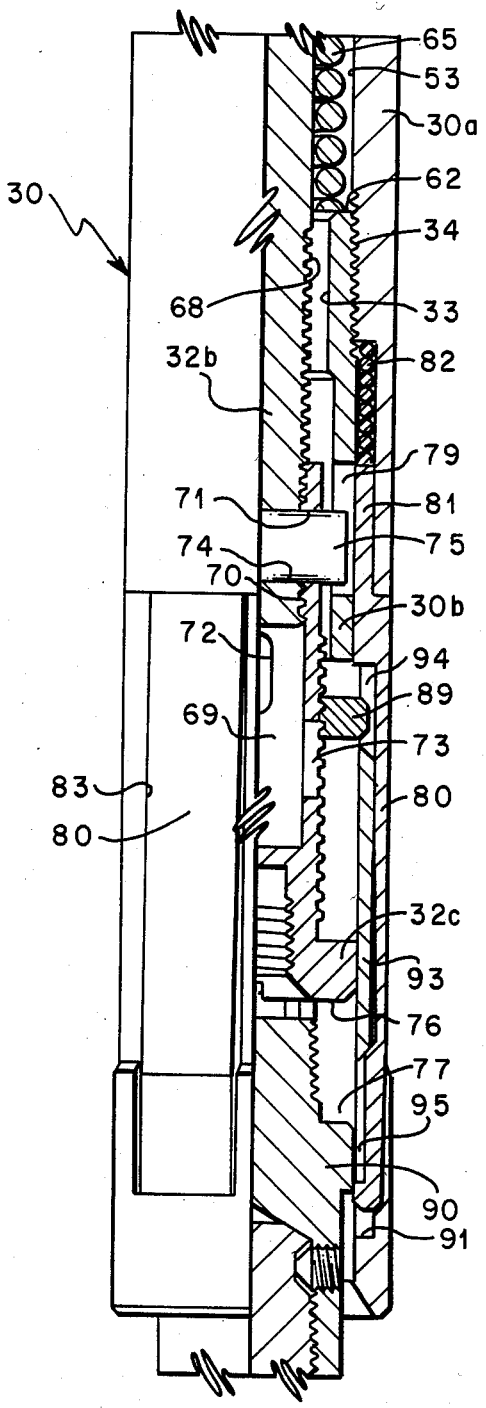
FIG. 18 is a drawing, partially in section and partially in elevation with portions broken away, showing the lower portion of the pulling tool engaging the fishing neck of a well tool.

Tool string 20 includes socket member 23 secured to wireline 21, sinker or weight bars 24, wireline or link jars 25, and swivel joint 26. Pulling tool 29 is engaged with swivel joint 26 by threads 31. As explained in U.S. Pat. No. 3,628,822, a pulling tool is generally used to retrieve a well tool from a downhole location by engaging a suitable fishing neck on the well tool. An example of such a fishing neck 90 is shown in FIG. 18. Wireline tool string 20 can be manipulated at the well surface (not shown) by conventional techniques to apply either an upward or downward shearing force to pulling tool 29. As will be explained later in more detail, pulling tool 29 can be assembled to release a well tool by application of either an upward or downward shearing force.

Pulling tool 29 has two major subassemblies, housing means 30 and elongate core means 32. Core means 32 comprises first section 32*a*, second section 32*b* and third section 32*c*. Housing means 30 comprises first housing subsection 30*a* and second housing subsection 30*b*. Each housing subsection has a generally circular cross section. The housing subsections are concentrically engaged by threads 34. Longitudinal passageway 33 extends through both housing subsections. Core means 32 is slidably disposed within longitudinal passageway 33.

Figure 15:
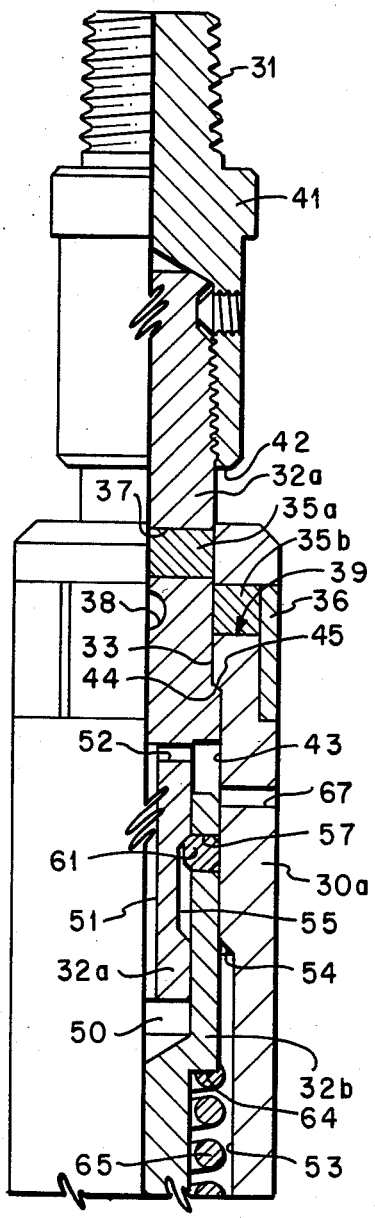
FIG. 15 is a drawing, partially in section and partially in elevation with portions broken away, showing the upper portion of the pulling tool after upward shearing forces have been applied to release the pulling tool from a well tool.
Figure 16:
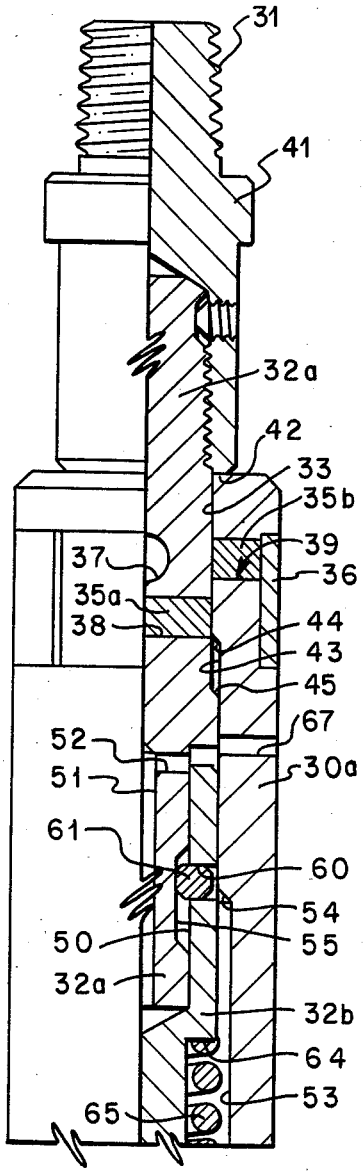
FIG. 16 is a drawing, partially in section and partially in elevation with portions broken away, showing the upper portion of the pulling tool after downward shearing forces have been applied to release the pulling tool from a well tool.

Shear pin 35 releasably secures first section 32*a* of core means 32 to first housing subsection 30*a*. First section 32*a* has two shear pin holes 37 and 38 extending radially therethrough and spaced longitudinally from each other. Housing subsection 30*a* has shear pin holes 39 and 40 radially opposite from each other and extending through subsection 30*a*. Pulling tool 29 is assembled with shear pin 35 disposed in shear pin holes 39 and 40 and either shear pin hole 37 or shear pin hole 38 of core means 32. Retainer sleeve 36 is attached to the exterior of housing means 30 and covers shear pin holes 39 and 40. When pin 35 is sheared as shown in FIGS. 15 and 16, sleeve 36 retains parts 35*b* of shear pin 35 within pulling tool 29. One advantage of the present invention is containment of all shear pin parts within tool 29 rather than allowing parts 35*b* to drop into the well bore.

One end of first section 32*a* extends longitudinally from passageway 33. Fishing neck 41 is attached to the one end of first section 32*a* and is engageable by threads 31 with wireline tool string 20. Fishing neck 41 also provides first shoulder 42 on the exterior of core means 32. The longitudinal spacing between first shoulder 42 and shear pin hole 37 is selected so that shoulder 42 abuts housing means 30 when pin 35 is disposed within shear pin holes 37, 39, and 40. Abutting contact between shoulder 42 and housing means 30 prevents downward shearing forces from being applied to pin 35 when disposed within shear pin hole 37.

Figure 2A:
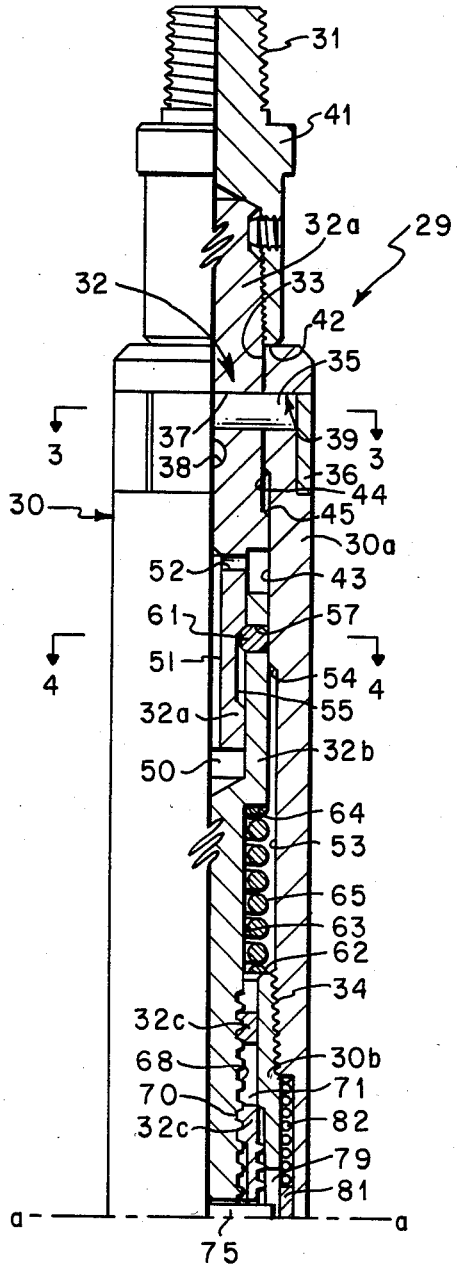
FIGS. 2A and 2B are drawings, partially in section and partially in elevation, showing the pulling tool of the present invention configured to engage a long fishing neck and to be disengaged or released by upward shearing forces.
Figure 8:
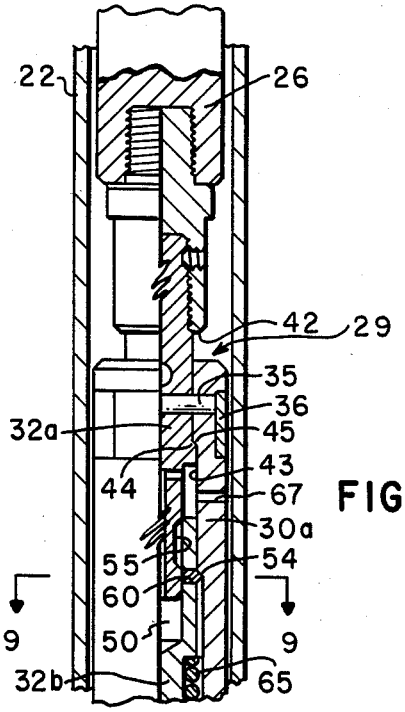
FIG. 8 is a schematic drawing, partially in section and partially in elevation with portions broken away, showing the upper portion of the pulling tool suspended from a wireline tool string within a well flow conductor. The pulling tool is configured to be released by downward shearing forces.
Figure 9:
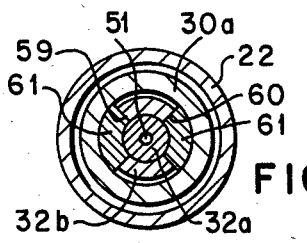
FIG. 9 is a horizontal cross section taken along lines 9—9 of FIG. 8.
Figure 3:
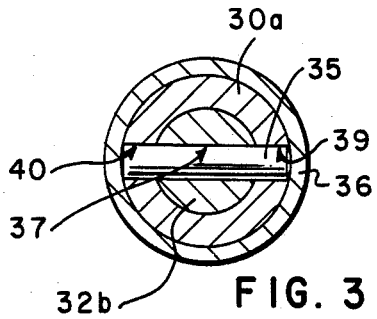
Figure 4:
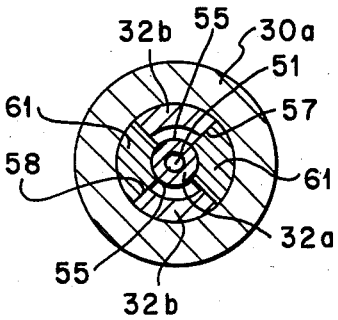

Longitudinal passageway 33 has a first enlarged inside diameter portion 43 which forms first shoulder 44 within housing means 30. The exterior of first section 32*a* within passageway 33 is enlarged to form second shoulder 45 on core means 32. Second shoulder 45 faces first shoulder 44 of longitudinal passageway 33. When pulling tool 29 is assembled with shear pin 35 in shear pin hole 37 as shown in FIG. 2A, shoulders 44 and 45 are longitudinally spaced from each other. When pulling tool 29 is assembled with shear pin 35 in shear pin hole 38 as shown in FIG. 8, shoulders 44 and 45 abut each other. In this later position, upward shearing forces from wireline tool string 20 are prevented from being applied to pin 35. Core means 32 can only be released from housing means 30 by application of upward shearing forces when pin 35 is disposed in hole 37 as shown in FIG. 2A. Alternatively, core means 32 can only be released from housing means 30 by application of downward shearing forces when pin 35 is disposed in hole 38 as shown in FIG. 8.

One end of second section 32*b* has longitudinal bore 50 partially therethrough. The other end of first section 32*a* is slidably disposed within bore 50. Counterbore 51 extends partially through the other end of first section 32*a* and communicates with bore 50. Lateral port 52 extends between counterbore 51, the exterior of core means 32 and longitudinal passageway 33. Lateral port 52 equalizes fluid pressure between the components within pulling tool 29 during longitudinal movement of first section 32*a* and second section 32*b* with respect to each other and/or housing means 30. Another lateral port 67 extends through housing means 30 to equalize fluid pressure between longitudinal passageway 33 and the exterior of pulling tool 29.

Figure 14:
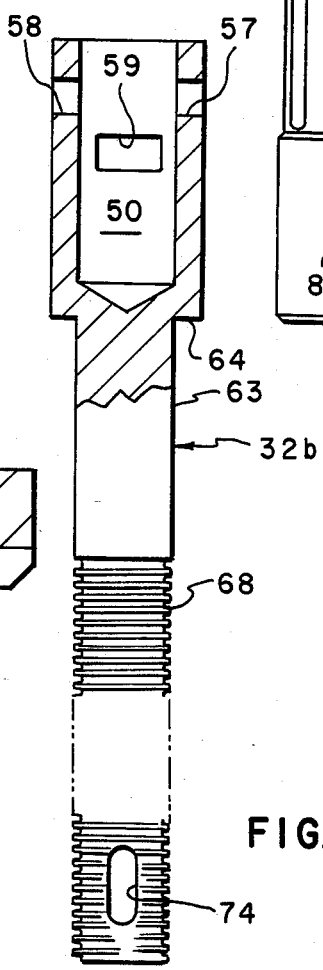
FIG. 14 is a reduced drawing, partially in section and partially in elevation, of the first section of the elongate core means.

Longitudinal passageway 33 has a second enlarged inside diameter portion 53 which forms second shoulder 54 spaced longitudinally from first shoulder 44 within housing means 30. Annular recess 55 is formed in the exterior of first section 32*a* spaced longitudinally between second shoulder 45 on the exterior of core means 32 and the other end of first section 32*a*. Radial openings 57, 58, 59, and 60 are formed in the exterior of second section 32*b* and communicate with bore 50. Referring to FIG. 14, openings 57 and 58 are shown radially opposite from each other. Openings 59 and 60 are also spaced radially opposite from each other and are spaced longitudinally from the pair of openings 57 and 58. Opening 60 is cut away for purposes of explanation. A pair of lugs 61 is disposed in either openings 57 and 58 or openings 59 and 60. When pulling tool 29 is assembled with pin 35 in shear pin hole 37, lugs 61 are preferably inserted into openings 57 and 58 as shown in FIGS. 2A and 15. When pulling tool 29 is assembled with pin 35 in shear pin hole 38, lugs 61 are preferably inserted into openings 59 and 60 as shown in FIGS. 8 and 16.

The one end of second section 32*b* is sized to be slidable between inside diameter 43 of housing means 30 and the exterior of first section 32*a*. Lugs 61 are sized to be larger than the distance between inside diameter 43 and the exterior of first section 32*a* adjacent thereto. Therefore, when pulling tool 29 is assembled, lugs 61 must project either outwardly toward second enlarged inside diameter 53 or inwardly into recess 55.

The engagement of second housing subsection 30*b* by threads 34 with first housing subsection 30*a* forms third shoulder 62 within passageway 33. Outside diameter 63 of second section 32*b* is significantly reduced below bore 50. This change in outside diameter forms third shoulder 64 of core means 32 facing third shoulder 62 of passageway 33. Spring 65 is carried on the exterior of second section 32*b* between third shoulder 62 and third shoulder 64. Spring 65 comprises part of the means for urging core means 32 to move longitudinally in one direction after pin 35 has been sheared to release housing means 30 from core means 32.

When pulling tool 29 is assembled with pin 35 in shear pin hole 37 and lugs 61 in openings 57 and 58, pin 35 prevents longitudinal movement of first section 32*a* with respect to housing means 30. Spring 65 urges second section 32*b* in the one direction with respect to housing means 30 and first section 32*a*. Inside diameter portion 43 cams or projects lugs 61 inwardly into recess 55 securing second section 32*b* with first section 32*a* to restrict longitudinal movement of core means 32 with respect to housing means 30 until after pin 35 has been sheared.

When pulling tool 29 is assembled with pin 35 in shear pin hole 38 and lugs 61 in openings 59 and 60 as shown in FIG. 8, pin 35 again prevents longitudinal movement of first section 32*a* with respect to housing means 30. Spring 65 again urges second section 32*b* in the one direction with respect to housing means 30 and first section 32*a*. The longitudinal spacing between shear pin hole 38 and openings 59 and 60 is selected so that the exterior of first section 32*a* below recess 55 cams or projects lugs 61 outwardly into contact with shoulder 54. In this configuration, lugs 61 prevent longitudinal movement of second section 32*b* relative to housing means 30. Thus, first section 32*a* and second section 32*b* are secured to housing means 30 to restrict longitudinal movement of core means 32 with respect to housing means 30 until after pin 35 has been sheared.

Threads 68 are formed on the exterior of second section 32*b* extending from the other end of second section 32*b* towards shoulder 64. Third section 32*c* has a longitudinal bore 69 extending from one end partially therethrough. Threads 70 are formed on the interior of bore 69 near the one end. Outside diameter 63 of second section 32*b* and the inside diameter of bore 69 are sized to allow engagement of threads 68 and 70. This engagement between threads 68 and threads 70 comprises part of the means for adjusting the "reach" of pulling tool 29. "Reach" will be defined later.

Three pairs of slots 71, 72, and 73 are cut through the exterior of third section 32*c* and communicate with bore 69. Slot 74 with dimensions compatible with slots 71, 72, and 73 is cut through second section 32*b* near the other end thereof. Key 75 is sized to be positioned in slot 74 and one pair of either slots 71, 72, or 73. Pulling tool 29 has three different "reaches" determined by the pair of slots 71, 72, or 73 in which key 75 is inserted. Pulling tool 29 can have multiple reaches by varying the number and location of slots cut through the exterior of third section 32*c*. Threaded hole 130 is provided in end 76 for attachment of an equalizing prong (not shown) if required by the downhole condition.

Second housing subsection 30*b* extends longitudinally from the other end 76 of third section 32*c*. Chamber or opening 77 is provided within second housing subsection 30*b* to receive a well tool such as fishing neck 90 therein. Chamber 77 is partially defined by the portion of longitudinal passageway 33 between end 76 of core means 32 and the other end of housing means 30 opposite fishing neck 41. The volume of chamber 77 can be varied by adjusting the thread engagement between second section 32*b* and third section 32*c*.

Second housing subsection 30*b* is a generally cylindrical sleeve with a reduced outside diameter portion 100 at one end carrying threads 34. Matching threads 34 are formed on the interior of first housing subsection 30*a* spaced longitudinally between shoulder 54 and the other end of first housing subsection 30*a*. Inside diameter 101 between threads 34 and the other end of subsection 30*a* is significantly larger than outside diameter portion 100 of subsection 30*b*. This difference in diameters forms annulus 102 when housing subsections 30*a* and 30*b* are engaged by threads 34.

Reduced outside diameter portion 100 has a pair of keyways 79 formed therethrough. Key 75 is sized to be longer than the outside diameter of third section 32*c* so that when pulling tool 29 is assembled, a portion of key 75 extends into each keyway 79. Key 75 and keyways 79 cooperate to prevent rotation of core means 32 with respect to housing means 30. The length of keyway 79 is selected so as not to restrict the longitudinal movement of core means 32 with respect to housing means 30.

Figure 19:
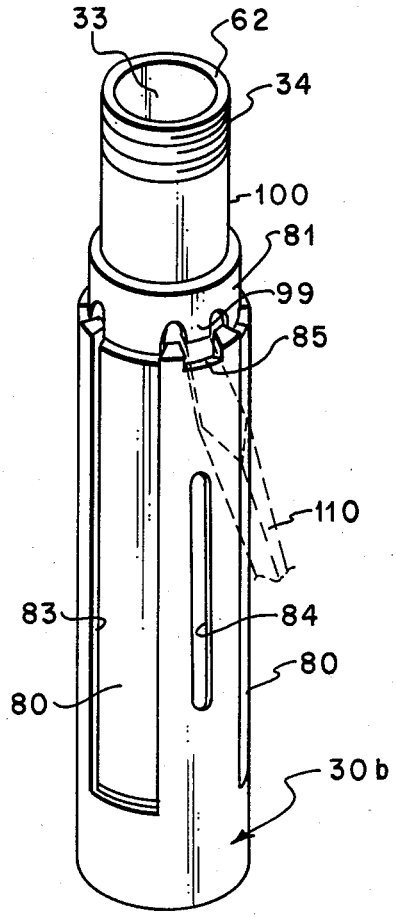
FIG. 19 is a drawing, partially in section and partially in elevation with portions broken away, showing the manual release feature of the pulling tool.

As best shown in FIG. 19, cylindrical ring 81 is disposed around reduced outside diameter portion 100. Flexible latching fingers 80 project longitudinally from ring 81. Each latching finger 80 has a square shoulder 87 which projects radially inward with respect to opening or chamber 77. Shoulder 87 is longitudinally spaced from end 76 of core means 32. This distance determines the maximum length of a fishing neck which can be engaged by pulling tool 29. This distance is commonly referred to as the "reach". One significant advantage of the present invention is that the reach of pulling tool 29 can be varied by adjusting the threaded engagement between second section 32*b* and third section 32*c* and inserting key 75 into either slots 71, 72, or 73. Slots 73 correspond to the longest reach for tool 29. Slots 71 correspond to the shortest reach, and slots 72 correspond to a medium reach.

Figure 7:
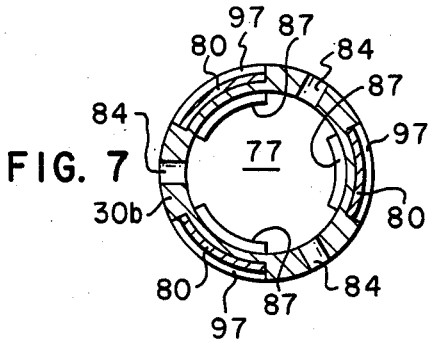
Figure 11:
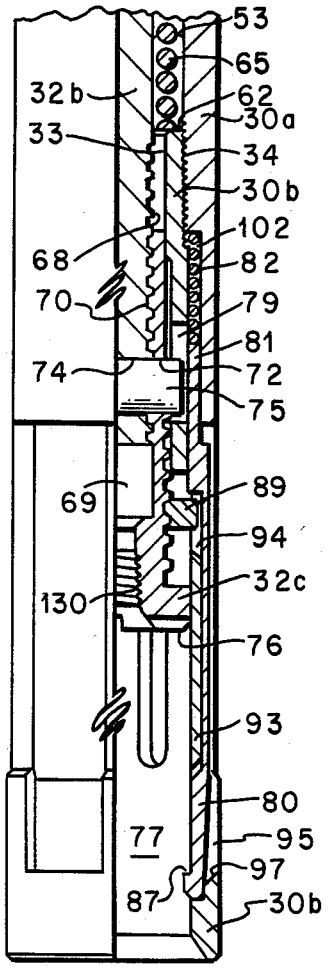
FIG. 11 is a drawing, partially in section and partially in elevation, showing the lower portion of the pulling tool configured to engage a medium length fishing neck.
Figure 12:
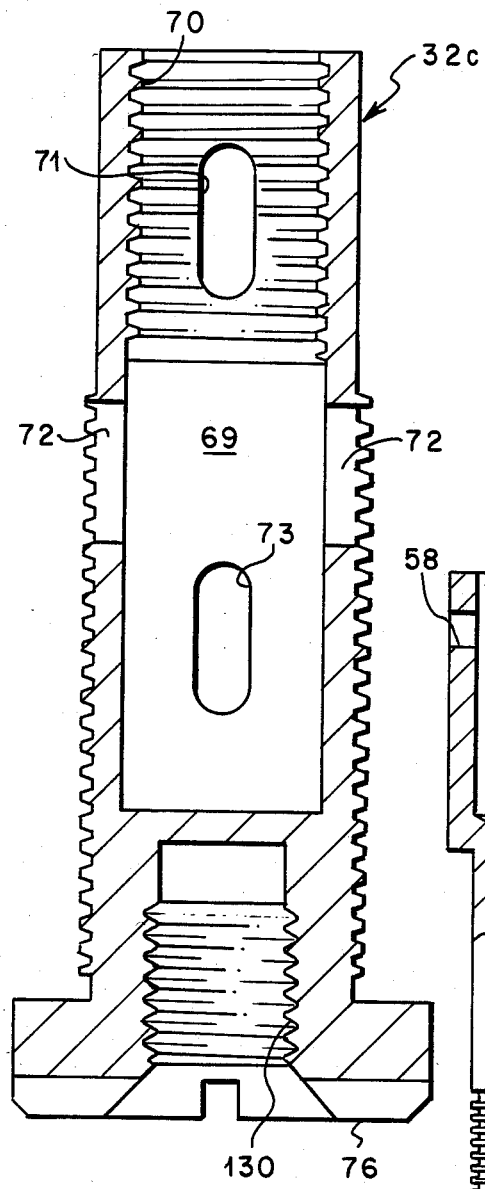
FIG. 12 is an enlarged drawing in longitudinal section showing the third section of the elongate core means.
Figure 13:
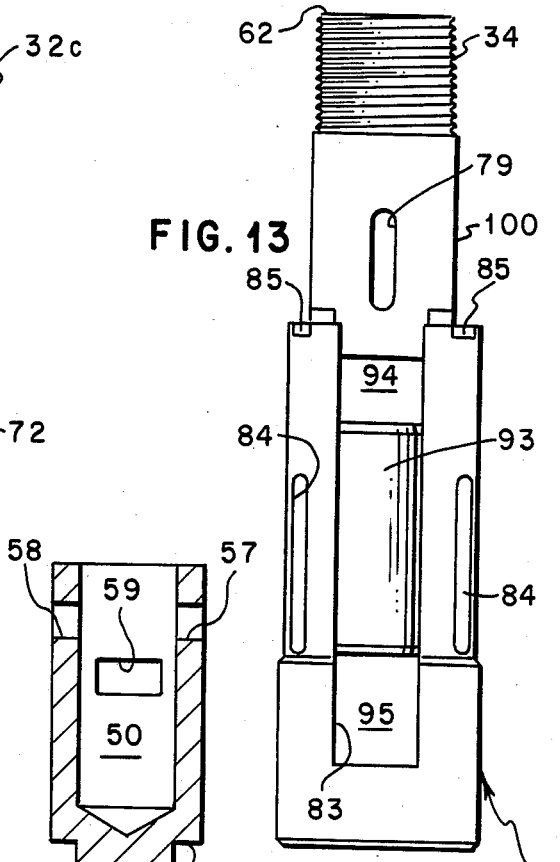
FIG. 13 is a drawing in elevation of the second subsection of the housing means.

Second housing subsection 30*b* has a plurality of longitudinal windows 83 machined in its exterior. Each finger 80 is fitted into a corresponding window 83. As best shown in FIGS. 7, 11, and 13, upper portion 94 and lower portion 95 of each window 83 is completely removed to allow access to chamber 77. Middle portion 93 of window 83 is only partially removed to provide lateral support for fingers 80 and to retain the structural strength of second housing subsection 30*b*. Middle portion 93 also engages fingers 80 to expand them radially outward when shifted to their second position. A plurality of longitudinal slots 84 is machined through the exterior of subsection 30*b* between each window 83. Slots 84 allow fluids to easily escape as a fishing neck enters chamber 77.

Figure 2B:
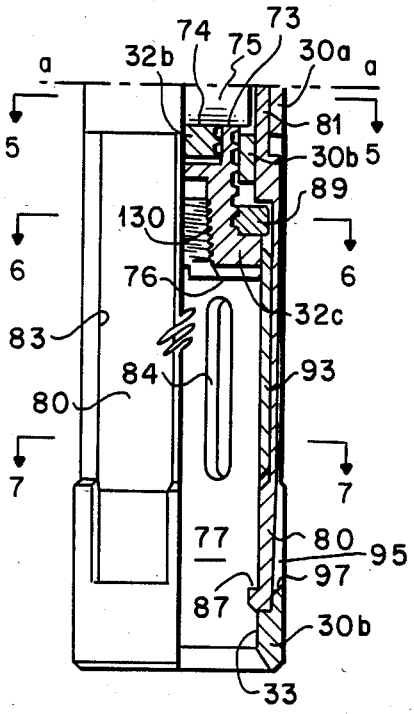
Figure 5:
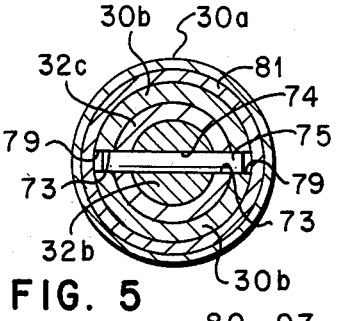
FIGS. 3 through 7 are horizontal cross sections taken on lines 3—3, 4—4, 5—5, 6—6, and 7—7 of FIGS. 2A and 2B.
Figure 17:
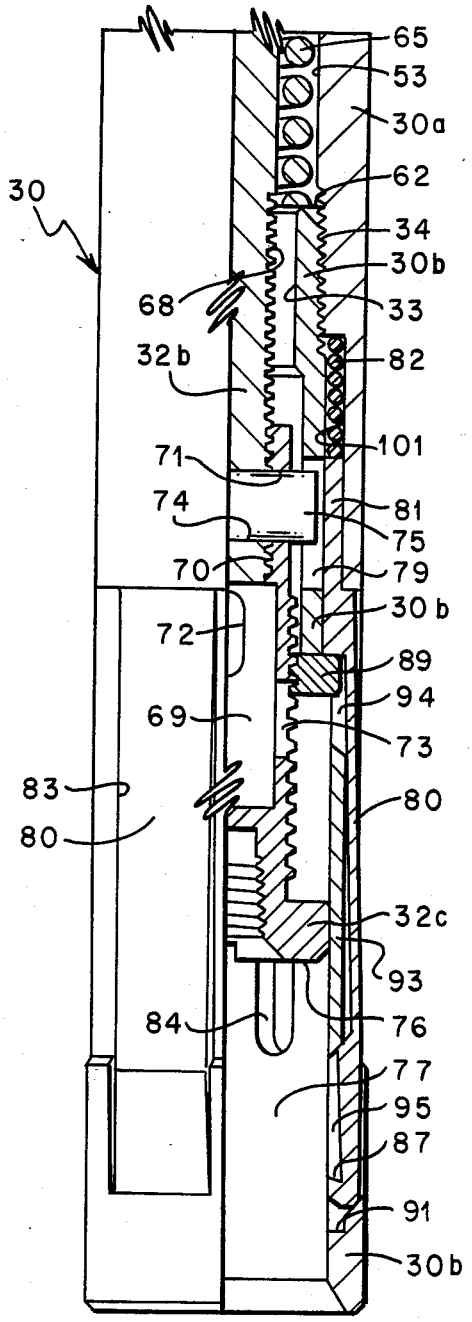
FIG. 17 is a drawing, partially in section and partially in elevation with portions broken away, showing the lower portion of the pulling tool after emergency release from a well tool.

The end of each lower portion 95 of window 83 has an inwardly tapered ramp 97 and a recess 91 to receive the end of its respective finger 80 carrying shoulder 87. Each finger 80 has a first position in which it is flexed inward allowing its respective shoulder 87 to secure a fishing neck within chamber 77. Fingers 80 function as a collet in which the first position is the normal, at rest condition for the collet. The first position of fingers 80 is illustrated in FIG. 2B. Each finger 80 also has a second position in which it is flexed outward to release a fishing neck from chamber 77. The second position of fingers 80 is illustrated in FIGS. 17 and 18. If no other forces are present, fingers 80 will automatically return to their first position.

Spring 82 is disposed within annulus 102 abutting ring 81 and biasing fingers 80 to their first position with shoulder 87 projected into opening 77. Spring 82 is selected to overcome any friction force and to move fingers 80 from their second position to their first position. Ramp 97 cooperates with spring 82 to guide fingers 80 inwardly into their respective recess 91.

FIG. 18 shows fishing neck 90 of a well tool (not shown) entering chamber 77. This represents an intermediate position while pulling tool 29 is being engaged with fishing neck 90. During the engagement process, fishing neck 90 forces fingers 80 upward and radially outward to their second position as fishing neck 90 enters chamber 77. Spring 82 is compressed by the longitudinal movement of fingers 80. When fishing neck 90 contacts end 76 or core means 32, spring 82 can return fingers 80 to their first position so that shoulders 87 will secure fishing neck 90 within chamber 77.

As best shown in FIG. 19, notch 85 is provided partially through the exterior of second housing subsection **30*b* adjacent to ring 81. A boss 99 is provided intermediate each finger 80 on ring 81. Screw driver 110 or any other suitable hand tool can be inserted into notch 85 contacting boss 99 to move ring 81 and fingers 80 longitudinally with respect to housing 30. This longitudinal movement compresses spring 82, expands fingers 80, and moves shoulders 87 radially outward releasing any well tool which may be secured within chamber 77. Thus, fishing neck 90 can be easily removed from pulling tool 29 at the well surface without having to disassemble pulling tool 29. When fishing neck 90 is secured within chamber 77, the full weight of the well tool attached to fishing neck 90 is transmitted directly through shoulder 87 to recess 91 and housing 30. Thus, fingers 80** are not required to support the weight of the well tool being retrieved from a downhole location.

During the normal operation of pulling tool 29, core means 32 does not move longitudinally relative to housing means 30. After pulling tool 29 has been assembled with the desired reach, only fingers 80 and ring 81 move longitudinally as well tools are secured within and released from chamber 77.

Figure 6:
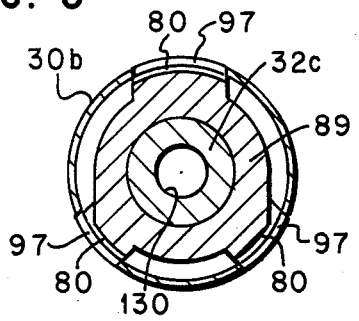
Figure 20:
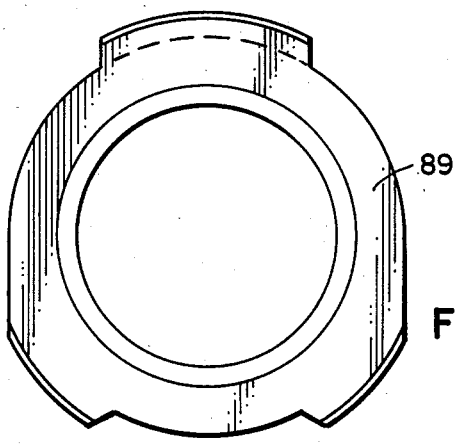
FIG. 20 is a plan view of the core nut which is part of the means for releasing or disengaging the pulling tool from a well tool by application of shearing forces.
Figure 10:
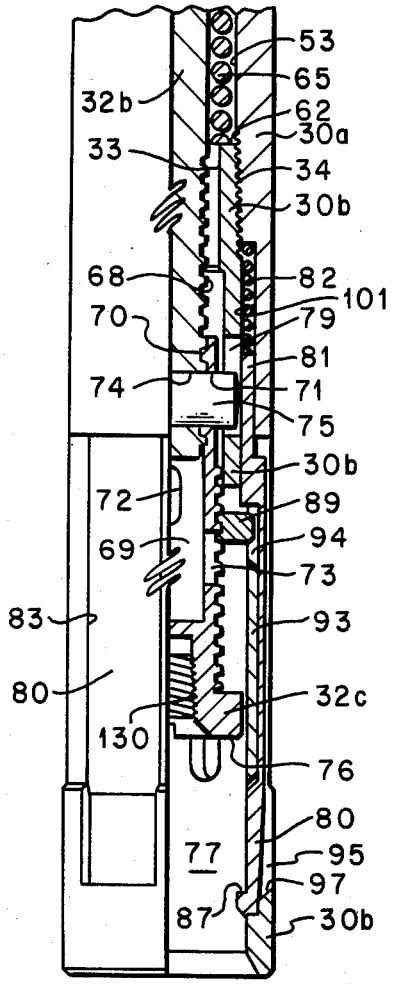
FIG. 10 is a drawing, partially in section and partially in elevation, showing the lower portion of the pulling tool configured to engage a short fishing neck.

As previously noted, pin 35 can be sheared to allow longitudinal movement of core means 32 relative to housing means 30. Core nut 89 is engaged by threads to the exterior of third section **32*c* with a portion of core nut 89 projecting into upper portion 94 of each window 83. Thus, longitudinal movement of core means 32 in the one direction relative to housing means 30 causes core nut 89 to contact ring 81 and to shift fingers 80 to their second position. As best shown in FIG. 6 and 20, the maximum outside diameter of core nut 89 is larger than the inside diameter of chamber 77. Therefore, part of core nut 89 must be machined away so that only three portions have the maximum outside diameter. When assembling pulling tool 29, core nut 89 is first inserted into chamber 77 with its maximum outside diameter portions projecting into upper portions 94. Third section 32*c* is then threaded through core nut 89 and engaged with second section 32*b***.

ASSEMBLY PROCEDURES

Pulling tool 29 can be assembled so that either upward or downward shearing forces can be applied to release core means 32 from housing means 30 during an emergency condition. Pin 35 is positioned within shear pin hole 38 and lugs 61 within radial holes 59 and 60 when downward shearing forces are desired for emergency release. This configuration is shown in FIG. 8. Pin 35 is positioned within shear pin hole 37 and lugs 61 within radial holes 57 and 58 when upward shearing forces are desired for emergency release. This configuration is shown in FIG. 2A. The selection of upward or downward shearing forces for emergency release depends upon well conditions downhole and the well tool which will be engaged by pulling tool 29.

Pulling tool 29 has three possible reach positions depending upon whether key 75 is inserted into either slots 71, 72, or 73. Again, the selection of reach position depends upon the length of the fishing neck of the well tool which will be engaged by pulling tool 29.

EMERGENCY RELEASE

Pulling tool 29 may properly engage a well tool, but the well tool may be stuck within the well flow conductor. Under these circumstances, manual shifting of fingers 80 to their second position using notch 85 is not possible. Therefore, an emergency release feature has been provided.

Assuming pulling tool 29 has been assembled with pin 35 in shear pin hole 37, upward force is applied to fish neck 41 and first section **32*a* by conventional wireline techniques until pin 35 shears as shown in FIG. 15. First section 32*a* can move longitudinally in the one direction relative to housing means 30 until shoulders 44 and 45 contact each other. Spring 65 urges second section 32*b* to move longitudinally in this same direction until lugs 61 abut the upper part of recess 55. Longitudinal movement of second section 32*b* is transmitted directly to third section 32*c* by their threaded engagement and key 75. Therefore, spring 65 moves second section 32*b* and third section 32*c* longitudinally as a single unit. This movement results in core nut 89 contacting ring 81 and fingers 80 to shift fingers 80 to their second position. Thus, any well tool or fishing neck within chamber 77 will be released by application of upward shearing forces. The position of core means 32 and core nut 89 with respect to housing means 30 after emergency release is shown in FIG. 17**.

The following sequence will occur if pulling tool 29 has been assembled for emergency release by downward shearing forces. Downward force is applied to fish neck 41 and first section **32*a* by conventional wireline techniques until pin 35 shears as shown in FIG. 16. First section 32*a* moves longitudinally in the other direction relative to housing means 30 until shoulder 42 contacts housing means 30. This movement positions recess 55 opposite lugs 61. The force of spring 65 in the one direction and tapered shoulder 54 cooperate to cam or project lugs 61 radially inward into recess 55. This movement of lugs 61 releases second section 32*b* from housing means 30. Spring 65 can then move second section 32*b* and third section 32*c* longitudinally in the one direction as previously described for release by upward shearing forces. FIG. 16 represents an intermediate position for core means 32 immediately after pin 35** has sheared.

After pin 35 has been sheared by downward force, upward force is applied to fishing neck 41 to return pulling tool 29 to the well surface. This upward force shifts core means 32 to the same position as shown in FIG. 15. Third section 32*c*, core nut 89, and fingers 80 eventually move to the same position as shown in FIG. 17 whether upward or downward shearing forces are used for emergency release.

The previous description is illustrative of only one embodiment of the present invention. Those skilled in the art will readily see other variations and modifications for a pulling tool utilizing the present invention. Such changes and modifications may be made without departing from the scope of the invention which is defined in the claims.

What is claimed is:

1. A pulling tool comprising:

a. an elongate core means having a first, second, and third section;

b. a housing means releasably secured to the first section and surrounding the exterior of the second and third sections of the core means;

c. one end of the first section projecting longitudinally from the housing means for engagement with a wireline tool string;

d. the second section having a longitudinal bore extending partially therethrough from one end and threads on the other end;

e. the other end of the first section slidably disposed within the bore of the second section;

f. one end of the third section having threads thereon and engageable with the threads on the other end of the second section;

g. the housing means extending longitudinally from the other end of the third section and having an opening therein to receive a well tool;

h. flexible latching fingers, carried by the third section and the housing means, extending longitudinally from the other end of the third section;

i. a shoulder on each finger, spaced longitudinally from the other end of the third section, projecting radially inward with respect to the opening;

j. the fingers having a first position in which the fingers are flexed inward allowing the shoulders to secure a well tool within the opening and a second position in which the fingers are flexed outward to release the shoulders from the well tool; and k. means for varying the longitudinal spacing between the other end of the third section and the shoulders by adjusting the threaded engagement between the second and third sections of the core means.

2. A pulling tool, as defined in claim 1, further comprising:

a. means for biasing the fingers toward their first position;

b. means for engaging the fingers by the core means to allow longitudinal movement of the core means in one direction with respect to the housing means to shift the fingers from their first position to their second position; and c. means for releasably securing the core means to the housing means to restrict longitudinal movement of the core means with respect to the housing means until after the core means has been released from the housing means.

3. A pulling tool, as defined in claim 2, wherein the housing means further comprises:

a. a first housing subsection threadedly engaged with a second housing subsection and a longitudinal passageway exending through both housing subsections;

b. the housing means having a generally circular cross section; and c. the core means slidably disposed within the longitudinal passageway.

4. A pulling tool, as defined in claim 3, further comprising:

a. the first section of the core means having first and second shear pin holes radially therethrough;

b. the shear pin holes in the core means longitudinally spaced from each other;

c. the first housing subsection having two shear pin holes radially opposite from each other and sized to receive a pin extending through one of the shear pin holes in the core means;

d. a first shoulder on the exterior of the core means abutting the housing means when a pin is positioned within the first shear pin hole and the shear pin holes of the housing means;

e. a first enlarged inside diameter portion of the longitudinal passageway forming a first shoulder within the housing means;

f. a second shoulder carried on the exterior of the first section of the core means within the housing means and facing the first shoulder of the longitudinal passageway;

g. the second shoulder of the core means abutting the first shoulder of the longitudinal passageway when a pin is positioned within the second shear pin hole and the shear pin holes of the housing means; and h. the abutting contact of the first shoulder of the core means with the housing means preventing downward shearing forces from being applied to a pin positioned within the first shear pin hole and the abutting contact of the second shoulder of the core means with the first shoulder of the longitudinal passageway preventing upward shearing forces from being applied to a pin positioned within the second shear pin hole.

5. A pulling tool, as defined in claim 4, further comprising:

a. a second enlarged inside diameter portion of the longitudinal passageway forming a second shoulder spaced longitudinally from the first shoulder within the housing means;

b. a recess formed on the exterior of the first section of the core means and spaced longitudinally from the second shear pin hole;

c. radial holes in the exterior of the second section of the core means communicating between the exterior of the core means and the bore of the second section;

d. a lug disposed within each radial hole and sized to project either radially outward or inward with respect to the bore of the second section of the core means;

e. the second shoulder, recess, radial holes, and lugs comprising part of the means for releasably securing the core means to the housing means; and f. means for urging the core means to move longitudinally in the one direction when the core means is released from the housing means.

6. A pulling tool, as defined in claim 5, further comprising:

a. longitudinal windows through the exterior of the second housing subsection and a flexible latching finger carried within each window;
b. a ring supported on the exterior of the third section of the core means between the outside diameter of the third section and the inside diameter of the housing means;
c. each flexible latching finger attached to and extending longitudinally from the ring;
d. a recess formed in the interior of the housing means and comprising a portion of the extreme end of each window longitudinally spaced from the other end of the third section; and
e. the extreme end of each finger opposite the ring resting within the recess when the fingers are in their first position to support the weight of a well tool, secured within the opening, by the housing means.

7. A pulling tool, as defined in claim 6, wherein the urging means further comprises:
a. a third shoulder within the passageway of the housing means facing the second shoulder of the passageway;
b. a third shoulder on the exterior of the core means spaced longitudinally from the radial holes of the second section and facing the third shoulder of the passageway; and
c. a spring disposed between the third shoulder of the core means and the third shoulder of the passageway.

8. A pulling tool, as defined in claim 7, wherein the means for varying the longitudinal spacing between the other end of the third section and the shoulders of the latching fingers further comprises:
a. a plurality of pairs of radial slots spaced longitudinally from each other through the exterior wall of the third section of the core means;
b. a radial slot through the other end of the second section of the core means; and
c. a key disposed within the radial slot of the core means and a selected pair of the radial slots in the third section of the core means.

9. A pulling tool comprising:
a. an elongate core means having a first, second, and third section;
b. the first section having a first shear pin hole and a second shear pin hole extending radially therethrough and spaced longitudinally from each other;
c. a housing means releasably secured to the first section by a pin disposed within either a first or second shear pin hole in the first section;
d. a first shoulder formed on the exterior of the first section and spaced longitudinally from the first shear pin hole in the first section to allow upward force to shear a pin disposed within the first shear pin hole;
e. a second shoulder formed on the exterior of the first section and spaced longitudinally from the second shear pin hole in the first section to allow downward force to shear a pin disposed within the second shear pin hole;
f. one end of the first section projecting longitudinally from the housing means for engagement with a wireline tool string;
g. the second section having a longitudinal bore extending from one end partially therethrough and threads on the other end;
h. the other end of the first section slidably disposed within the bore of the second section;
i. one end of the third section having threads thereon and engageable with the threads on the other end of the second section;
j. the housing means extending longitudinally from the other end of the third section and having an opening therein to receive a well tool;
k. flexible latching fingers, carried by the third section and the housing means, extending longitudinally from the other end of the third section;
l. a shoulder on each finger, spaced longitudinally from the other end of the third section, projecting radially inward with respect to the opening; and
m. the fingers having a first position in which the fingers are flexed inwardly allowing the shoulders to secure a well tool within the opening and a second position in which the fingers are flexed outwardly releasing the well tool from the opening.

10. A pulling tool, as defined in claim 9, further comprising means for varying the longitudinal spacing between the other end of the third section and the shoulders of the fingers including:
a. a plurality of pairs of radial slots spaced longitudinally from each other through the wall of the third section of the core means;
b. a radial slot through the other end of the second section of the core means; and
c. a key disposed within the radial slot in the second section of the core means and a selected pair of the radial slots in the third section of the core means.

11. A pulling tool, as defined in claim 9, further comprising:
a. means for biasing the fingers toward their first position;
b. means for engaging the fingers by the core means to allow longitudinal movement of the core means in one direction with respect to the housing means to shift the fingers from their first position to their second position; and
c. means for releasably securing the first section and second section of the core means to restrict longitudinal movement of the core means with respect to the housing means until after the core means has been released from the housing means.

12. A pulling tool, as defined in claim 9, wherein the housing means further comprises:
a. a first housing subsection threadedly engaged with a second housing subsection and a longitudinal passageway extending through both housing subsections;
b. the housing means having a generally circular cross section;
c. the core means slidably disposed within the longitudinal passageway; and
d. the first housing subsection having two shear pin holes radially opposite from each other and sized to receive a pin extending through either the first or second shear pin hole of the core means.

13. A pulling tool, as defined in claim 9, further comprising:
a. longitudinal windows through the exterior of the second housing subsection and a flexible latching finger carried within each window;
b. a ring supported on the exterior of the third section of the core means between the outside diameter of the third section and the inside diameter of the housing means;

c. each flexible latching finger attached to and extending longitudinally from the ring;

d. a recess formed in the interior of the housing means and comprising a portion of the extreme end of each window longitudinally spaced from the other end of the third section; and e. the extreme end of each finger opposite the ring resting within the recess when the fingers are in their first position to support the weight of a well tool, secured within the opening, by the housing means.

14. A pulling tool, as defined in claim 13, having means for positive engagement of a well tool within the opening comprising:

a. the shoulder on each finger;

b. the extreme end of each finger; and c. the recess in the respective window.

15. A pulling tool, as defined in claim 9, wherein the means for varying the longitudinal spacing between the other end of the third section and the shoulders of the latching fingers further comprises:

a. a plurality of pairs of radial slots spaced longitudinally from each other through the exterior wall of the third section of the core means;

b. a radial slot through the other end of the second section of the core means; and c. a key disposed within the radial slot of the core means and a selected pair of the radial slots in the third section of the core means.

* * * * *